US005524752A

United States Patent [19]

Mazzucchelli

[11] Patent Number: 5,524,752

[45] Date of Patent: Jun. 11, 1996

[54] ANTI-SHOPLIFTING BOX WITH A COMPACT LOCKING DEVICE OPENABLE BY MAGNETIC ACTION COMBINED WITH MECHANICAL ACTION

[75] Inventor: Arnaldo Mazzucchelli, Grumello del Monte, Italy

[73] Assignee: Plasti-Max S.p.A., Bergamo, Italy

[21] Appl. No.: 437,504

[22] Filed: May 9, 1995

[30] Foreign Application Priority Data

May 10, 1994 [IT] Italy ..... BG94A0021

[51] Int. Cl.[6] ..... B65D 85/57

[52] U.S. Cl. ..... 206/308.2; 206/387.11; 206/1.5

[58] Field of Search ..... 206/307.1, 308.1, 206/308.2, 308.3, 387.11, 1.5, 807

[56] References Cited

U.S. PATENT DOCUMENTS 5,275,291 1/1994 Sledge ..... 206/807

5,316,144 5/1995 Habelt ..... 206/1.5

FOREIGN PATENT DOCUMENTS 508201 10/1992 European Pat. Off. ..... 206/308.2

2628717 9/1989 France ..... 206/1.5

*Primary Examiner*—Thomas P. Hilliard

*Attorney, Agent, or Firm*—Steinberg, Raskin & Davidson

[57] ABSTRACT

This anti-shoplifting box has the characteristic of a particularly compact locking device openable by magnetic action combined with manual mechanical action, said device including, on an object-containing drawer, a tongue which is internal and transversely holed for engagement by a cylindrical end stem, having a spherical head with a circumferential undercut, of a ferromagnetic body which is also cylindrical but of greater diameter such as to provide an annular stop ledge for the action of a compressed spring contained within an axial hole therein and reacting against an edge of the box.

8 Claims, 4 Drawing Sheets

ANTI-SHOPLIFTING BOX WITH A COMPACT LOCKING DEVICE OPENABLE BY MAGNETIC ACTION COMBINED WITH MECHANICAL ACTION

BACKGROUND OF THE INVENTION

This invention relates to an anti-shoplifting box with a compact locking device openable by magnetic action.

As is well known, with modern distribution methods the customer has direct access to goods, being able to pick them up and touch them.

This evidently exposes the goods to shoplifting. To prevent this happening, transparent object containers are used provided with active or passive electronic devices which enable their presence to be detected when, hidden by the shoplifter, they approach positions provided with specific sensors. These usual containers can be opened, to extract the object and transfer it to a paying customer, only by powerful magnets used by the shop assistant.

Such conventional boxes are very bulky by virtue of the locking devices, which lack the necessary rationality to enable their cost and dimensions to be reduced. These usual containers are locked substantially by bolts which can be made to slide not only by magnetic attraction but also by inertial thrusts caused by deliberate impact.

OBJECTS AND SUMMARY OF THE INVENTION

An object of the present invention is to define a magnetically opened anti-shoplifting box comprising a particularly compact locking device.

A further object is to define a box openable by two cooperating actions which can only be performed by the proper set expedients. A further object is to define a box of the aforesaid type which is of particularly low cost.

A further object is to define a box of the aforesaid type which allows the contained product to be extracted in different ways. These and further objects will be seen to be attained on reading the non-limiting detailed description given hereinafter of an anti-shoplifting box characterised by comprising a particularly compact locking device openable by magnetic action combined with manual mechanical action, said device comprising, on an object-containing drawer, a tongue which is internal and transversely holed for engagement by a cylindrical end, stem, having a spherical head with a circumferential undercut, of a ferromagnetic body which is also cylindrical but of greater diameter such as to provide an annular stop ledge for the action of a compressed spring contained within an axial hole therein and reacting against an edge of the box, said ferromagnetic body operating within a small substantially cube-shaped and possibly composite member fixed in a corner position within a box-like guide structure for the sliding of the drawer, to undergo the extractive action of a traditional external auxiliary magnet by the effect of a combined manual mechanical action which overcomes the thrust in the opening direction exerted by the preload of a spring and releases the undercut engagement of the spherical head, said extractive action enabling the drawer to be slid as required for freeing the object contained in the box.

BRIEF DESCRIPTION OF THE DRAWINGS

The invention is illustrated by way of non-limiting example on the accompanying drawings, in which.

DETAILED DESCRIPTION OF THE PREFERRED EMBODIMENTS

With reference to the aforesaid figures, a box structure 1 is provided to house a drawer 2 for containing objects 3 having their quadrangular perimeter expressed by an indefinite line. Examples of such objects are cased compact-discs or video-cassettes, ie flat objects of appreciable value.

Figure 2:
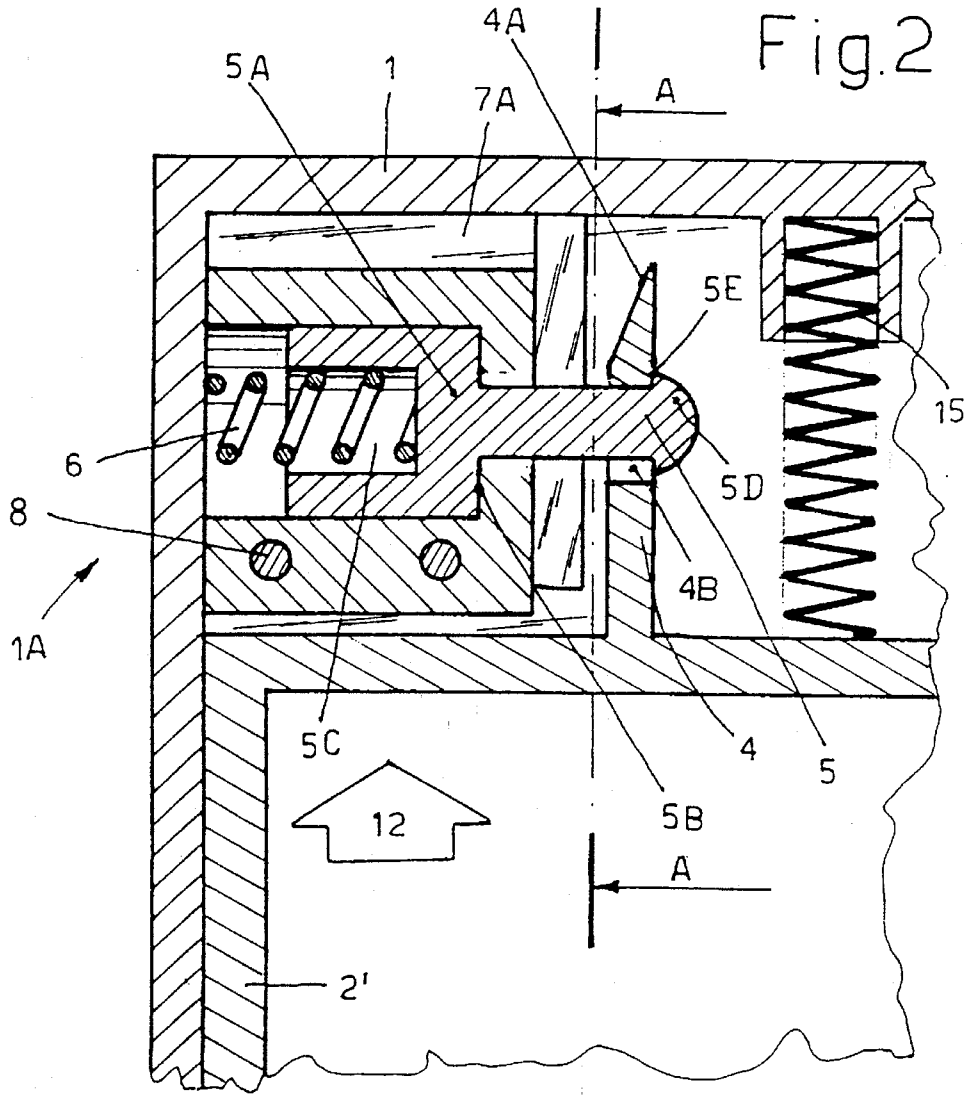
FIG. 2 shows an enlarged detail of the said box which better illustrates the constituent parts of its locking device.

The drawer 2 is provided on its most inner edge with a tongue 4 having an inclined surface 4A and a transverse hole 4B (FIG. 2). The purpose of the inclined surface 4A is to cause a spheroidal head 5D of a cylindrical end stem 5 to slide along it so as to guide it onto the mouth of the transverse hole 4, into which it automatically penetrates by the thrust of a spring 6 which has been previously compressed by the rearward movement of the cylindrical stem 5 generated by the perpendicular sliding of the inclined surface 4A. The spherical head 5D is provided lowerly with circumferential undercuts 5E. The spherical head 5D is hence larger than the shank of the stem 5, The hole 4B is slightly larger than this head to allow its free passage. A spring 15 acts indirectly on the tongue 4 containing the hole 4B, hence when the hole 4B has been completely traversed by the spherical head 5D, this latter remains engaged on one side because of the shifting of the hole 4B.

This engagement of the undercut 5E of the spherical head 5D against the edge of the hole 4B of the tongue 4 prevents the stem 5 from sliding rearwards under the usual attracting action exerted by magnets. It also prevents inertial movements which could otherwise be caused by deliberate tampering impact. To enable the stem 5 to slide in order to disengage the two parts for opening purposes, the drawer 2' has to be pushed slightly forwards in the direction 12 indicated in FIG. 2. As the magnetic attracting action exerted in the meantime by the magnet is continuous, as soon as the extent of movement of the drawer 2' equals the extent of the undercut 5E the spherical head 5D and the hole 4B become aligned, so that the stem 5 can be extracted from the tongue 4 to disengage the drawer 2' from its guiding container 1.

Figure 6:
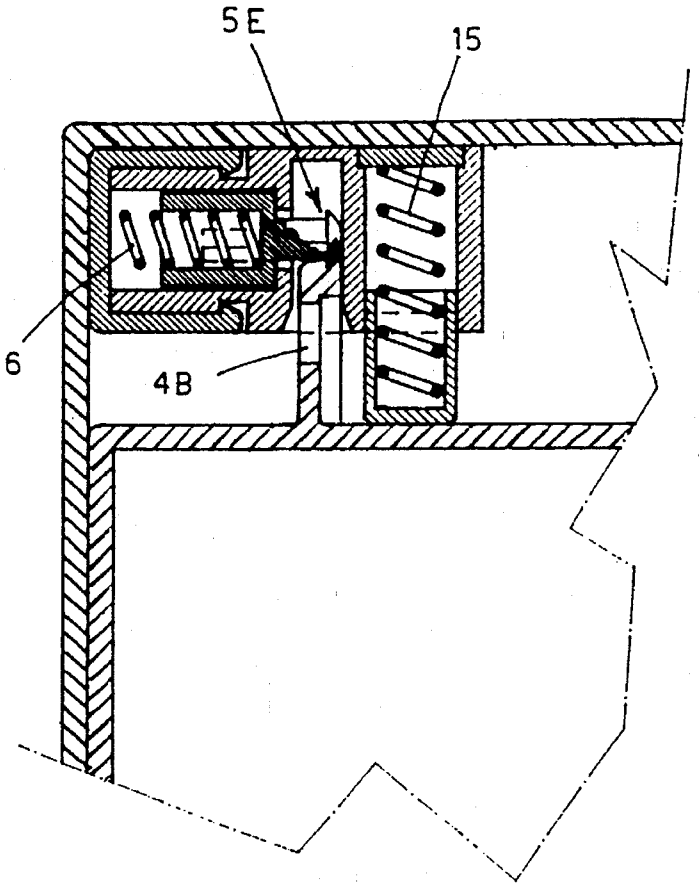
FIG. 6 is the same as shown in FIG. 5, but with the two parts of the box free but in an engagement initiation position.
Figure 5:
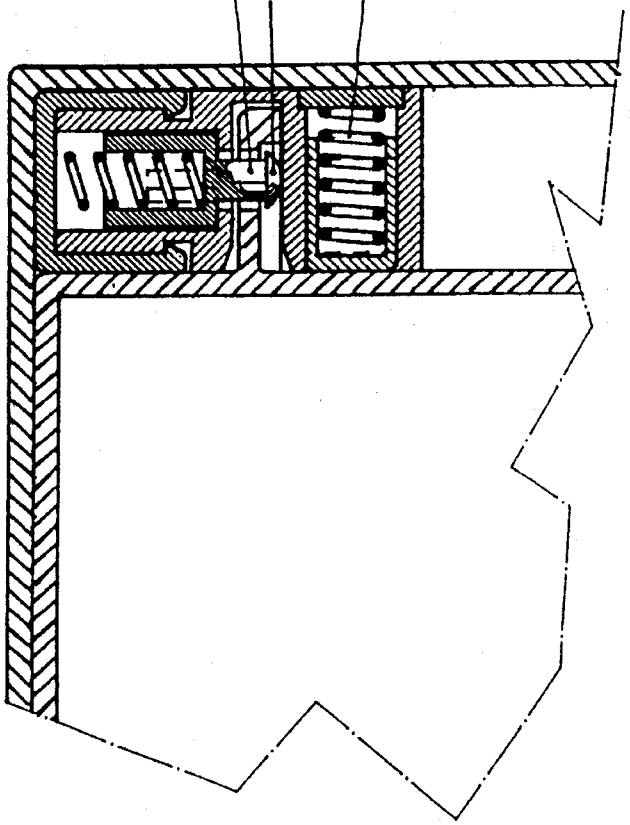
FIG. 5 shows a further embodiment of the device in the configuration in which the two parts of the box are locked together.

This operation is also clearly illustrated in FIGS. 5 and 6 in which equivalent parts are indicated by the same numerals. The cylindrical end stem 5 forms part of a ferromagnetic body 5A, which is also cylindrical but is of greeter diameter so as to define an annular ledge 5B acting as a limit stop against the end of the hole within which said ferromagnetic body 5A is free to slide. The ferromagnetic body 5A is provided with an axial hole 5C operationally housing a spring 6.

Figure 1:
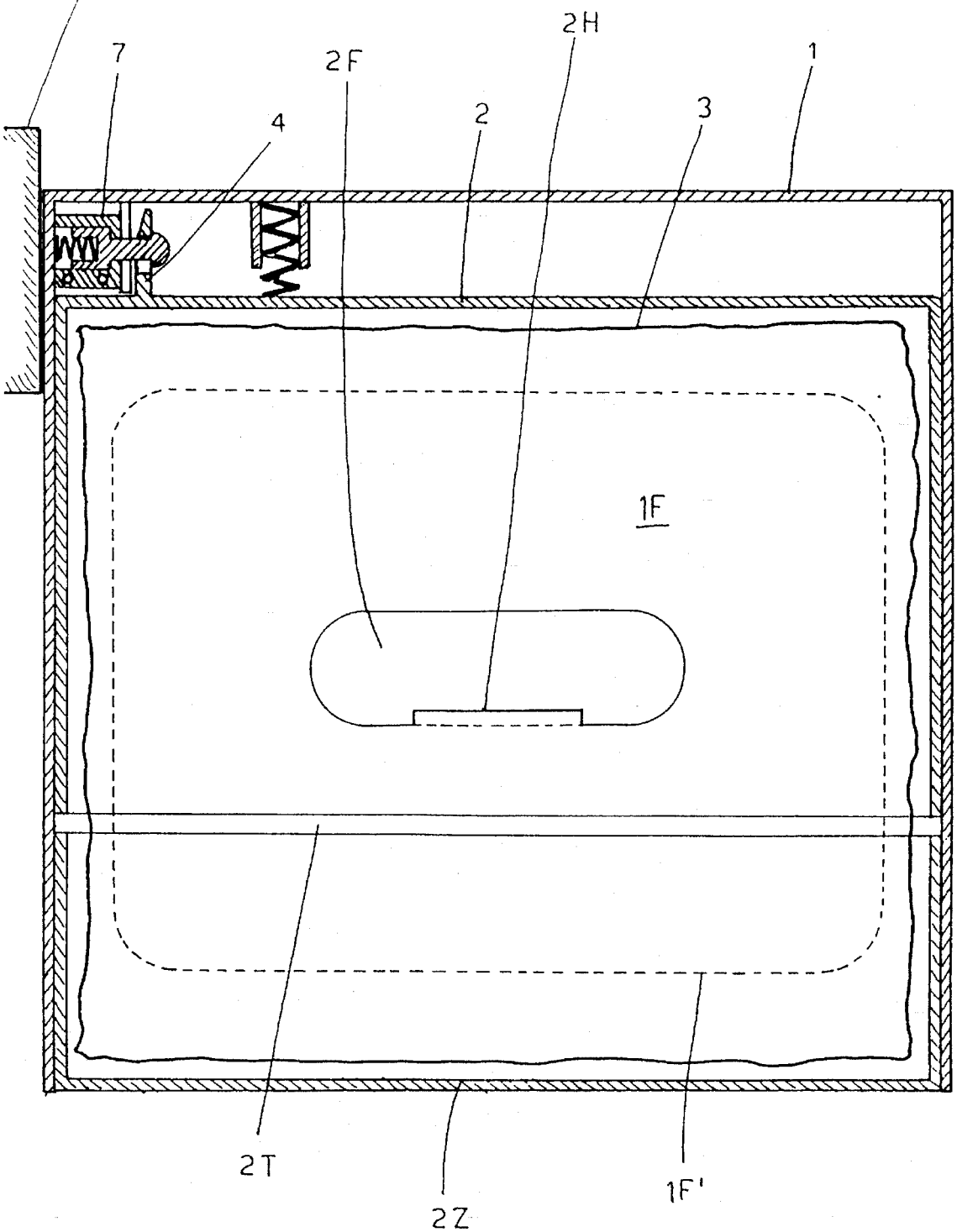
FIG. 1 is a sectional view on a centre plane through one embodiment of a flat parallelepiped box comprising a drawer with its body bendable when in the extracted position.
Figure 3:
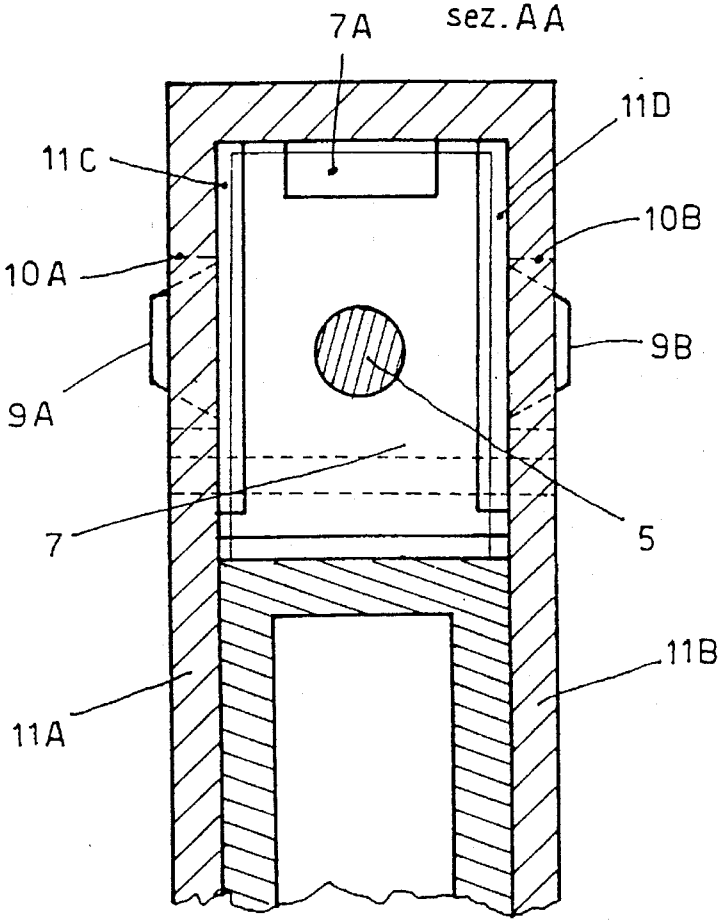
FIG. 3 is a perpendicular section through the detail shown in FIG. 2.

This spring freely rests against an edge 1A of the box 1. The ferromagnetic body BA is slidingly housed within a small cube-shaped plastics member 7. Said small cube-shaped member 7 is fixed into a corner of the box structure 1. This fixing can be achieved in various ways, for example by a pair of pins 8 as shown in FIG. 1, or by a pair of projections 9A, 9B inserted into suitable slots 10A, 10B (as shown in FIG. 3 by dashed lines) by virtue of the elastic yielding of the walls 11A and 11B. Both methods are shown in FIG. 3, however one is sufficient for correct operation.

FIG. 3 shows the small cube-shaped member 7 provided with a recess 7A for receiving the end of a screwdriver for removing it if required.

It can also be seen that said small cube-shaped member 7 is retained by two small projecting strips 11C and 11D integral with the walls 11A and 11B. These strips also allow the small cube-shaped member 7 to slide between them in the direction 12, so guiding it to its final location in which it is fixed by the stated methods.

By bringing the edge 1A of the box into contact with a magnet Q of suitable power, the ferromagnetic body 5A becomes attracted by it to hence extract the cylindrical end stem 5 from the transverse hole 4B present in the tongue 4.

As a result of this the drawer 2 is freed and can hence be extracted from its containing box structure to the extent necessary to give access to and remove the object previously contained in it.

The manner in which these objects can be removed also depends on their shape. In the case of the typical wide flat shapes of cased compact-discs the methods shown in FIGS. 1 and 4 can be used. In FIG. 1 the drawer is in the shape of a parallelepiped tray and the box structure 1 is provided with large openings 1F in its two sides, as indicated by dashed lines. In the bottom of the drawer there is an aperture 2F provided with an outwardly projecting edge 2H. On extracting the drawer, the edge 2H abuts against the edge 1F' of the opening, to halt against it and prevent complete extraction of the drawer.

To facilitate removal of the contained object, the drawer could be traversed by a cut 2T provided not only in its edges but also in its base to the extent that the remaining thicknesses are small enough to enable the projecting part 2Z of the drawer to be lowered by bending.

Figure 4:
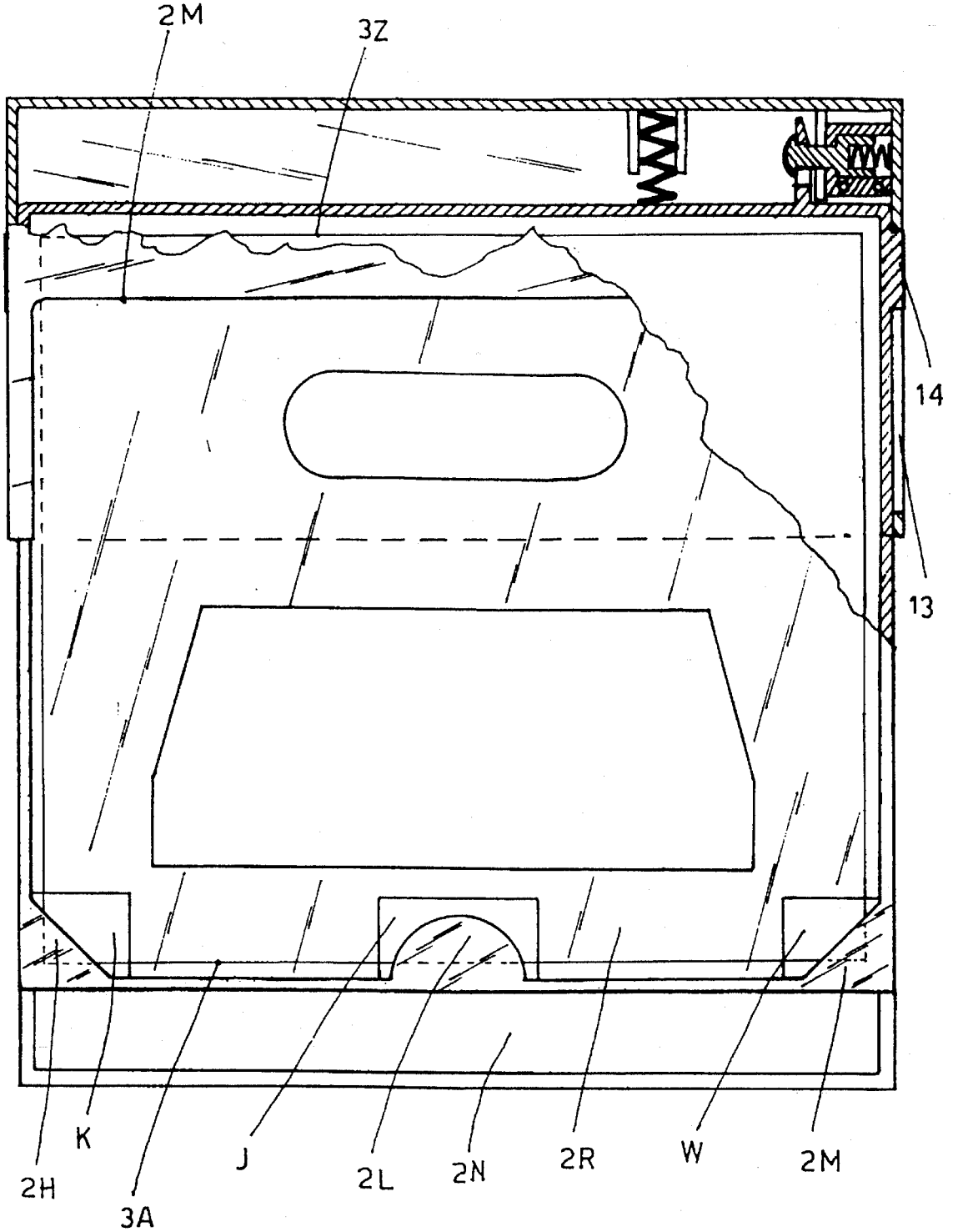
FIG. 4 shows a further embodiment of the box, which has a similar locking device to that shown in the preceding figures, but has its drawer projecting from the box structure which contains and guides it.
Figure 7:
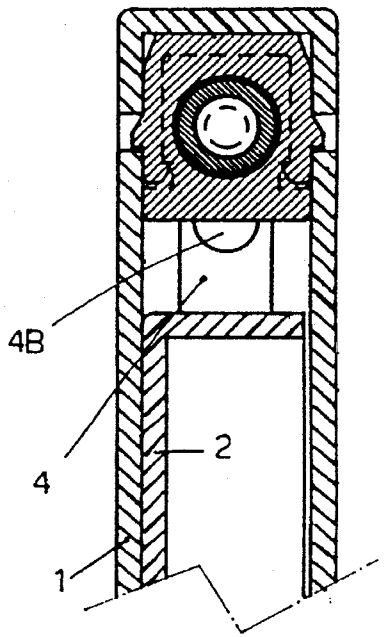
FIG. 7 is a lateral section through that shown in FIG. 6.

In the embodiment shown in FIG. 4, a quadrangular object, indicated by the thin line 3A, could be extracted with shorter movement of the drawer, as defined by the length of lateral slots 13 present in the box structure 1 and housing projections 14 extending from the drawer, an edge 3Z of the object having simply to overcome a neighbouring edge 2M of tile box structure, which in this version is particularly small.

This also enables the drawer 2R to have at its base a usual region 2N for its fixing to display devices which require the various containers to be "page-turned".

In the version of FIG. 4 the object (or cased compact-disc) is retained by short undercut walls 2H, 2L, 2M formed by moulding making use of usual holes K, J, W.

Advantageously, this version enables the amount of plastics used to be greatly reduced, while still performing its function of retaining the object within the container provided with known anti-shoplifting electronic indicator devices.

I claim:

1. An anti-shoplifting box comprising a particularly compact locking device openable by magnetic action (Q) combined with manual mechanical action, said device comprising, on a drawer (2) for containing objects (7), a tongue which is internal and transversely holed (4B) for engagement by a cylindrical end stem (5), having a spherical head (5D) with a circumferential undercut (5E), of a ferromagnetic body (5A) which is also cylindrical but of greater diameter such as to provide an annular stop ledge (5B) for the action of a compressed spring (6) contained within an axial hole (5C) in the body and reacting against an edge (1A) of the box, said ferromagnetic body (5A) operating within a small substantially cube-shaped plastics member (7), fixed in a corner position of a box-like guide structure for the sliding of the drawer (2), to undergo the extractive action of a traditional external auxiliary magnet (Q) by the effect of a combined manual mechanical action which overcomes the thrust in the opening direction exerted by the preload of a second spring (15) and releases the undercut engagement of the spherical head, said extractive action enabling the drawer (2) to be slid as required for freeing the object (3) contained in box.

2. An anti-shoplifting box as claimed in claim 1, characterised in that the small substantially cube-shaped plastics member (7) is fixed to the box by projections (9A, 9B) penetrating into slots (10A, 10B) in the box following elastic yielding of the box, said penetration being guided by two strips (11C, 11D).

3. An anti-shoplifting box as claimed in claim 1, characterised in that said small plastics member is fixed to the box (1) by a pair of pins (8).

4. An anti-shoplifting box as claimed in claim 1, characterised in that said small plastics member is provided with a recess (7A) to facilitate the possible removal of the member.

5. An anti-shoplifting box as claimed in claim 1, characterised by the drawer provided with a transverse cut (2T) to provide downward flexibility of a projecting portion (2Z), in order that can be lowered to facilitate removal of the contained object (3).

6. A box as claimed in claim 1, characterised by the tongue (4) provided with an inclined surface (4A) to cause the cylindrical end stem (5) to move rearwards before insertion of the stem into a transverse hole (4B) in said tongue as a result of the trust of the spring (6) loaded by the actual introduction of the drawer (2).

7. An anti-shoplifting box as claimed in claim 1, characterised in that the extent of travel of the drawer (2) is governed by the engagement between a projection (2H) on the drawer and an edge (1F) of an opening in the box (1).

8. An anti-shoplifting box as claimed in claim 1, characterised in that the extent of travel of the drawer (2) is governed by the engagement between a projection (14) on an edge of the drawer and the ends of a slot (13) provided in the box (1).

* * * * *